United States Patent [19]

Barker

[11] 4,221,271

[45] Sep. 9, 1980

[54] WATER JET CUTTING NOZZLE TRANSITION SECTION

[75] Inventor: Clark R. Barker, Rolla, Mo.

[73] Assignee: The Curators of the University of Missouri, Columbia, Mo.

[21] Appl. No.: 894,768

[22] Filed: Apr. 10, 1978

[51] Int. Cl.[2] ..... E21B 7/18

[52] U.S. Cl. ..... 175/422; 239/553.5

[58] Field of Search ..... 175/339, 340, 393, 422, 175/67; 299/17, 81; 166/222, 223; 239/553, 589

[56] References Cited

U.S. PATENT DOCUMENTS

| | | | |
|---|---|---|---|
| 1,017,638 | 2/1912 | McCoole | 239/553 |
| 1,060,929 | 5/1913 | Monberg | 175/422 X |
| 1,661,672 | 3/1928 | Morrison | 175/422 |
| 2,719,027 | 9/1955 | Bolce et al. | 175/340 |
| 2,746,721 | 5/1956 | Moore | 175/393 X |
| 3,137,354 | 6/1964 | Crawford et al. | 175/340 |
| 3,195,660 | 7/1965 | McKown | 175/339 X |
| 3,927,723 | 12/1975 | Hall et al. | 175/422 |

*Primary Examiner*—James A. Leppink
*Attorney, Agent, or Firm*—Ray E. Snyder

[57] ABSTRACT

This invention is directed to an internally tapered transition section to channel water or other cutting liquid from a supply pipe to a nozzle body having a plurality of orifices for liquid jet cutting. The transition section described herein is interposed between a supply pipe and a nozzle body and provides a smooth contour matching between the end of a supply pipe and a nozzle entrance whereby the water is conducted to the nozzle exits with a minimum generation of disturbance, mixing, and energy loss.

2 Claims, 5 Drawing Figures

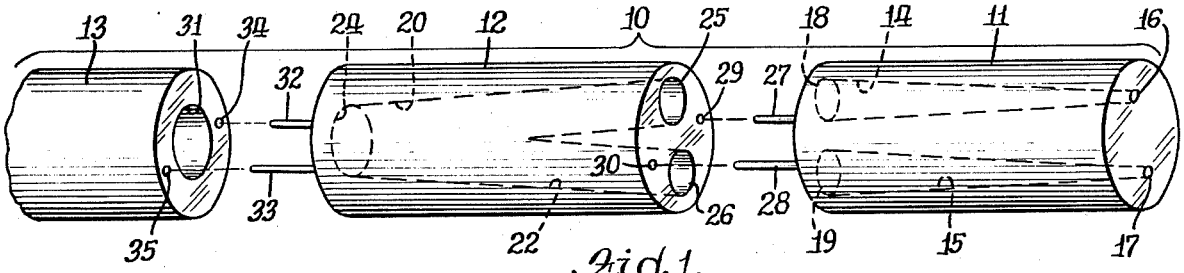
Fig. 1.
Fig. 2. PRIOR METHOD
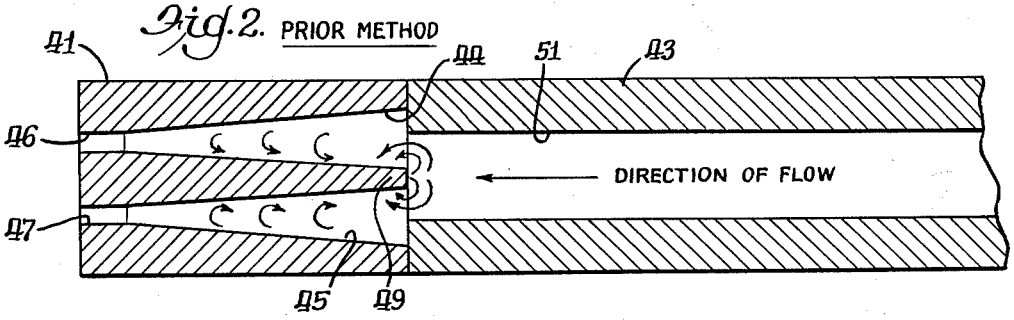
Fig. 3.
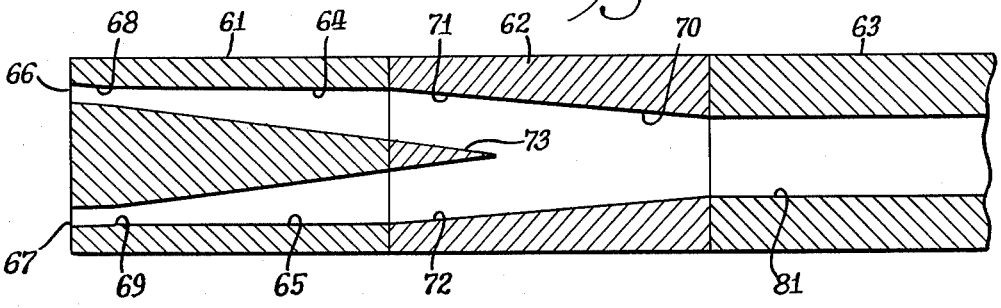
Fig. 4a.
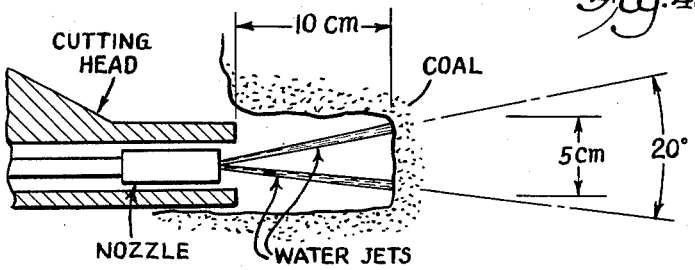
Fig. 4b.
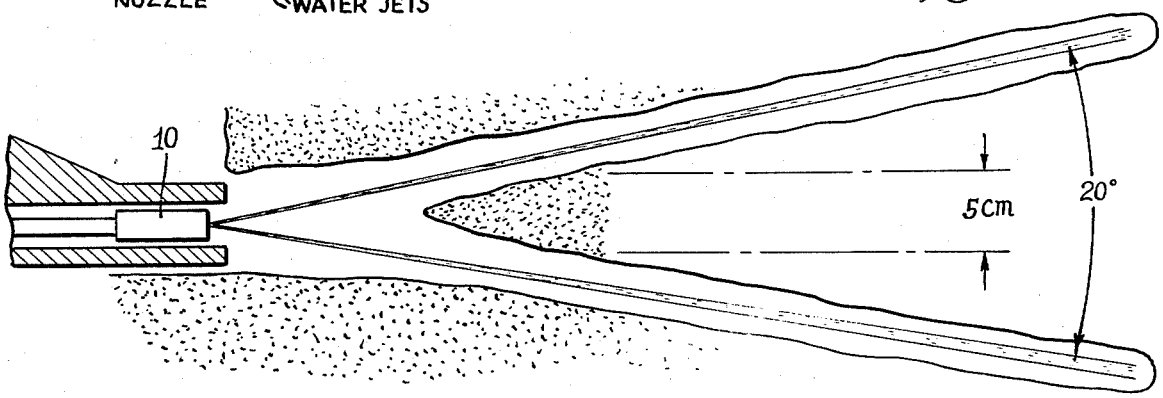

WATER JET CUTTING NOZZLE TRANSITION SECTION

BACKGROUND OF INVENTION

1. Field of the Invention

This invention relates generally to the field of Boring and Penetrating the Earth, and more particularly to method and apparatus for boring by fluid erosion.

2. Description of the Prior Art

The use of high pressure water jet streams for drilling and cutting of rock, coal and the like are well-known in the art and are exemplified by patents such as the following:

| | | |
|---|---|---|
| Juvkam-Wold | 3,924,698 | DRILL BIT AND METHOD OF DRILLING |
| Hall et al. | 3,927,723 | APPARATUS FOR DRILLING HOLES UTILIZING PULSED JETS OF LIQUID CHARGE MATERIAL |
| Morrison | 1,661,672 | APPARATUS FOR HYDRAULIC DRILLING |
| Fehlmann | 2,783,972 | INSTALLATION FOR MAKING BORES IN A STRATUM |
| Hayes | 3,785,875 | JET REAMER |
| Acheson | 3,576,222 | HYDRAULIC JET DRILL BIT |
| Noren | 3,960,407 | CUTTERS AND METHODS OF CUTTING |

In each of the above patents a nozzle is generally attached directly to the supply pipe with little or no consideration given to whether the internal dimensions or contour of the supply pipe match that of the inlet section of the nozzle. This apparently is based on the general assumption that water is a perfect fluid without shearing stress and that according to Pascal's law the fluid pressure is transmitted equally in all directions. At lower pressures this is substantially true, however changes occur at extremely high pressures as involved herein of 10,000 p.s.i. to 25,000 p.s.i. In the dynamic situation encountered in water jet cutting, the water passes from a supply conduit where it travels at a low velocity, e.g., 50 ft. per second through an exit nozzle at a velocity greater than 1,000 ft. per second. In undergoing this extreme increase in velocity the fluid converges and accelerates toward the exit nozzle. Any projections or irregularities of surface within the fluid conduit near the exit nozzle is apt to cause disturbances and turbulence within the fluid stream before it exits from the nozzle. Such turbulence tends to disrupt the stability of the water jets as they exit from the nozzle. The jets are therefore more susceptible to premature breakup and their coherent lengths are greatly reduced. This reduces the effective cutting length and the maximum standoff distance that can be obtained with the nozzle.

SUMMARY OF THE INVENTION

It is an object of the present invention to provide a transition section adapted to be used between a supply pipe and a fluid nozzle having two or more exit orifices. The interior dimensions of the fluid inlet portion of the transition section exactly matches the internal cross section of the fluid supply pipe. Similarly the fluid exit portion of the transition section exactly matches the internal dimensions of the nozzle entrance ports. The interior surfaces and finish of the transition section are to be as perfectly smooth as may economically be allowed.

It is another object to provide a plurality of locating pins for exactly aligning a transition section with respect to the nozzle.

It is still another object to provide a transition section of the type described made from a material such as brass. The material should be hard enough to withstand the internal pressures involved and soft enough so as to conform to small surface imperfections when they exist between the supply pipe and the transition section and between the nozzle and transition section.

BRIEF DESCRIPTION OF THE DRAWINGS

FIG. 1 is an exploded perspective view of the transition section interposed between a supply pipe and a nozzle body;

FIG. 2 is a cross-sectional schematic view of the prior art method of attaching a nozzle body to a supply pipe;

FIG. 3 is a cross-sectional schematic illustration of the transition section connected to a diverging dual jet nozzle body; and FIGS. 4*a* and 4*b* are comparative illustrations of the effect of the transition section in maintaining coherent jet streams.

DETAILED DESCRIPTION OF PREFERRED EMBODIMENT

A complete nozzle assembly is shown in exploded form in FIG. 1 and designated generally by the numeral 10. The assembly 10 comprises a nozzle body 11, a transition section 12 and a fluid supply conduit 13. The nozzle body 11 is formed with two tapered internal bores 14 and 15 which terminate at jet orifices 16 and 17, respectively. The tapered channels 14 and 15 have relatively large diameter inlet openings 18 and 19 respectively.

The transition section 12 is formed with an internal channel 20 which is divided into a pair of diverging channels 21 and 22 by a tapered partition 23. The channel 20 is formed with an inlet port or opening 24 and the channels 21 and 22 terminate at exit ports 25 and 26 respectively. The ports 25 and 26 are designed to match exactly with inlet ports 18 and 19 of the nozzle body 11. A pair of locating pins 27 and 28 may be attached to the nozzle body 11 and adapted to fit into a pair of holes 29 and 30 formed in the transition section 12.

The supply pipe or conduit 13 is formed with an internal cylindrical bore 31. The diameter of the inlet port 24 of transition section 12 is designed to match exactly the internal diameter of the channel 31. A pair of locating pins 32 and 33 may be attached to the transition section 12 and adapted to fit in a pair of holes 34 and 35 in the supply pipe 13 to assure exact alignment.

The importance of the transition section can best be appreciated by first referring to the prior art methods of attaching a nozzle body 41 to a supply pipe 43 as illustrated in FIG. 2. The nozzle body 41 has a pair of tapered channels 44 and 45 which terminate at nozzle orifices 46 and 47, respectively. A divided partition 49 separates the two channels 44 and 45.

As illustrated, no attempt has been made to match the internal dimensions of the supply pipe 43 having and internal bore 51 with the tapered channels 44 and 45. This results in a number of projections into the fluid stream from the supply pipe 43. The internal projections and irregularities create disturbances and turbulence in the fluid stream. This turbulence continues as the fluid is accelerated through the tapered channels 44 and 45 and results in a disturbance in the fluid stream ejected from the nozzle orifices 46 and 47. The result of these disturbances is to disrupt the stability of the water jets that exit from the nozzle. These jets are therefore more susceptible to premature breakup and their coherent lengths are greatly reduced, consequently the most effective cutting distances and maximum standoff distances are not achieved.

Referring now to FIG. 3, there is illustrated a typical nozzle system arrangement as intended by the present invention comprising nozzle 61, transition section 62, and supply pipe 63. These three elements are effectively locked together by external attachment means (not shown). The nozzle 62 is formed with two internal tapered channels 64 and 65 which terminate at nozzle orifices 66 and 67 respectively. The tapered channels 64 and 65 perferably are formed with an included angle of approximately 13°. The nozzle orifices 66 and 67 are separated from the channels 64 and 65 by straight sections 68 and 69 respectively. The straight sections 68 and 69 each have a length approximately three times the orifices' diameter. The transition section 62 is formed with an internal cylindrical channel 70 which matches exactly the internal dimensions of a channel 81 in supply pipe 63. The internal channel 70 is divided by a tapered partition 73. The divider 73 merges with the body of the section 62 to define two equal cylindrical exit channels 71 and 72. The cross-sectional dimensions of the channels 71 and 72 exactly match the inlet ports to the channels 64 and 65 formed in the nozzle body 61. The transition section thereby provides a smooth and equal separation from a single cylindrical fluid stream into two equal fluid streams. This manner of flow transition improves the performance of the water jets by reducing turbulence in flow and thereby increasing the coherent length of the jet ejected from the orifices 66 and 67.

It is also important for the performance of the nozzle that the interior surfaces between channels 64 and 65 and 71 and 72 be as smooth as is economically feasible. Preferably the surface finish of these channels should be less than 250 μmm. The transition section 62 preferably is constructed of material such as brass. This material is soft enough to conform to small surface imperfections present on the end faces of the nozzle body 61 and supply pipe 63 and thereby provide an effective high pressure seal. It is contemplated that the supply pipe 63 may be constructed of a relatively hard material such as stainless steel and the nozzle body be constructed of electro-formed nickel. It is also contemplated that the nozzle orifices 66 and 67 may have a diameter of the order of a magnitude of 1 mm and the internal diameter of the supply pipe of the order of a magnitude of 6 to 8 mm.

Experimental tests were conducted with this nozzle system using Berea standstone as a target sample. The cutting test conducted showed an improvement in volume of material removed in a given time of 200% over the same nozzle without the transition section. Even more significantly a nozzle system with the transition section demonstrated a 300% improvement in the coherent length of the jet stream. The ability to cut sandstone samples at maximum standoff distance was increased from 24 inches to 72 inches.

One application for the diverging nozzle system FIG. 3 is in a machine for cutting coal. In this application it is important to cut a slot approximately 5 cm. wide so as to admit the leading edge of a coal cutting plow. In an experimental set-up for the cutting of coal, the nozzle initially used had diverging jets of 20° separation. With a driving pressure of 700 bars and orifices diameters of 1 mm. this nozzle was found capable of cutting a slot 5 cm. wide to a depth of 10 cm. in coal.

With the addition of the transition section and other internal improvements, the effective distance for cutting of coal was extended to approximately 60 cm. This difference in performance is illustrated in FIGS. 4*a* and 4*b*. The slot width and effective cutting distance illustrated in FIGS. 4*a* and 4*b* is shown under static conditions. The required slot width is only approximately 5 cm. This slot width can be controlled by the speed of advance of the nozzle into the coal. The slot width can also be controlled by reducing the degree of divergence of the jet streams.

It is to be understood that the principles set forth above for the two jet nozzle system can be applied with equal effectiveness to a system having three, four or more jet orifices. It is necessary to provide as smooth and equal interior contour matching as possible so as to minimize the turbulence in the fluid streams ejected from the jet orifices.

The invention is not to be considered as limited to the embodiments shown and described except in-so-far as the claims may be so limited.

I claim:

1. A high pressure liquid jet system for cutting and drilling of geologic and other materials comprising:

a source of high pressure for pumping liquid in the system;

a nozzle constructed of relatively hard metal and formed with a plurality of exit orifices and internal bores opening into said orifices for delivering liquid at high velocity to the material to be cut;

a conduit interconnected between said source and said nozzle and formed with a predetermined internal bore;

a transition section constructed of metal relatively softer than the metal of said nozzle and interconnected between said nozzle and said conduit and being formed with a matching bore structure at one end for each of said nozzle bores and at the other end a matching bore for the conduit bore, said transition section defining a matched smooth flow directing path between said conduit bore and said internal nozzle bores.

2. A transition section adapted to be used in a high pressure liquid jet cutting system in conjunction with a liquid conduit formed with an internal bore and a nozzle body constructed of relatively hard metal formed with internal bores leading to at least two exit orifices comprising:

a rigid body portion constructed of metal relatively softer than the metal of the nozzle body and formed with an internal channel structure having an inlet port and at least two exit ports opening into said channel structure; and said inlet port closely matching the dimension of said conduit bore, said exit ports closely matching the dimensions of said nozzle bores, said transition section defining a smooth transition flow directing path between said conduit bore and said nozzle bores.

* * * * *